US008627924B2

(12) United States Patent
Calzolari

(10) Patent No.: US 8,627,924 B2
(45) Date of Patent: Jan. 14, 2014

(54) ARTICLE HANDLING MACHINE EQUIPPED WITH A FOLDABLE CATWALK

(75) Inventor: Michele Calzolari, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 557 days.

(21) Appl. No.: 12/933,392

(22) PCT Filed: Mar. 19, 2008

(86) PCT No.: PCT/IB2008/001238

§ 371 (c)(1),
(2), (4) Date: Dec. 2, 2010

(87) PCT Pub. No.: WO2009/115857

PCT Pub. Date: Sep. 24, 2009

(65) Prior Publication Data

US 2011/0072597 A1 Mar. 31, 2011

(51) Int. Cl.
*E04G 3/20* (2006.01)
*B67C 3/22* (2006.01)

(52) U.S. Cl.
USPC ..... 182/84; 134/62

(58) Field of Classification Search
USPC ..... 182/84; 134/62
See application file for complete search history.

(56) References Cited

U.S. PATENT DOCUMENTS

| | | | | | |
|---|---|---|---|---|---|
| 774,870 | A | * | 11/1904 | Ferrall | 403/11 |
| 1,335,999 | A | * | 4/1920 | Stover | 16/361 |
| 3,605,768 | A | | 9/1971 | Golding | |
| 3,606,475 | A | * | 9/1971 | Quisenberry | 301/112 |
| 4,118,044 | A | * | 10/1978 | Celms | 280/33.995 |
| 4,347,638 | A | * | 9/1982 | Weaver | 14/71.1 |
| 4,889,378 | A | * | 12/1989 | Sims | 296/57.1 |
| 5,964,566 | A | * | 10/1999 | Stewart et al. | 414/572 |
| 7,338,107 | B1 | * | 3/2008 | Wilcox et al. | 296/57.1 |

FOREIGN PATENT DOCUMENTS

| | | | |
|---|---|---|---|
| DE | 196 42 987 | A1 | 4/1998 |
| DE | 20 2004 001619 | U1 | 5/2004 |

* cited by examiner

*Primary Examiner* — Alvin Chin Shue
(74) *Attorney, Agent, or Firm* — Sughrue Mion, PLLC

(57) ABSTRACT

Article handling machine (1) comprising a frame (2) for receiving article handling elements, a roof (3) covering said frame (2), and, on one lateral side (6) of the machine (1), a catwalk (5) pivotally mounted on the frame (2) between an extended position in which it protrudes in a direction substantially perpendicular to the lateral side (6), with an inner edge facing the machine lateral side (6), and a folded position in which it stretches out in a direction substantially parallel to the lateral side (6).

9 Claims, 7 Drawing Sheets

ARTICLE HANDLING MACHINE EQUIPPED WITH A FOLDABLE CATWALK

FIELD OF THE INVENTION

The invention relates to article handling machines, and more especially to a device for easing maintenance operations of such machines.

BACKGROUND OF THE INVENTION

Article handling machines are used in a wide range of industries to process articles, for instance in bottle industry, pharmaceutical industry or in food packaging industry. Maintenance operations of such machines require access to every part of the machines, even to the roof.

The roof is a critical part. Indeed, many elements which demand regular maintenance are only accessible from the roof.

For instance, bulky power devices, such as electrical cabinets, may be mounted on the roof, in order to minimize the occupied space on the floor, and to place the apparatus as near as possible to the machine and to let a free access to the interior of the machine by the sides.

Structural parts of the machine, such as wheel axis or cap feed rails may be fixed to the roof, and should hence be accessible for installation and maintenance purposes; whereby, operators mount and walk on the roof to achieve the necessary steps.

Such operations may be hazardous for operators. Indeed, the space on the roof is generally limited and, as a large portion is already occupied by machine parts, such as the electrical cabinet, operators do not have much room where to move and store their tools.

In order to bring an element of solution, handrails have been placed along roof edges of some machines to secure operators' movements on the roof.

However, the mere handrail is an incomplete solution. Indeed, even if the risk of falling is minimized, the room available for operators is still insufficient.

Moreover, such machines must be moved at least once, from their setting place to a client place, by common transportation means, involving to pass through public roads. As the machine may be bulky by itself, it is a conception matter not to increase the width of the machine and to keep its dimensions in a reasonable average.

SUMMARY OF THE INVENTION

It is an object of the invention to provide an article handling machine, the design of which facilitates access to the roof and movement thereon, and yet permitting easy transportation of the machine, on transportation vehicles adapted for public roads.

The proposed article handling machine comprises a frame for receiving article handling elements, a roof covering said frame, and a catwalk on one lateral side of the machine. The catwalk is pivotally mounted on the frame between an extended position in which it protrudes in a direction substantially perpendicular to the lateral side, with an inner edge facing the machine lateral side, and a folded position in which it stretches out in a direction substantially parallel to the lateral side.

In a preferred embodiment, the frame comprises a flange, on the lateral side, said flange comprising an aperture, and the lateral catwalk may comprises an axis positioned near the inner edge, in the flange aperture, so that the catwalk can swivel around the machine, between the extended position and the folded position, by the rotation of the axis in the aperture.

The aperture in the flange aperture has e.g. a profile comprising a horizontal section receiving the axis in the extended position, and a vertical section receiving the axis in the folded position.

In addition, the catwalk may be held in the extended position by means of a locking device, which includes e.g. apertures positioned on the catwalk and the machine, in such a way that, in the extended position, an aperture in the machine is coaxial with an aperture in the catwalk, the locking device further including a fixation lug mounted through the apertures, for holding the catwalk in the extended position. More precisely, the fixation lug may comprise a clamping device, for tightening the lug in the apertures, said clamping device including two pins transversally inserted through the fixation lug on end portions.

Moreover, the catwalk may also comprise a plate, stretching out substantially perpendicularly to the catwalk and which, in the extended position, comes into abutment with the lateral side and may be fixed to the frame. A stiffener may also be provided on the catwalk, extending outwardly from the plate.

In a preferred embodiment, the catwalk is positioned at roof-height. In the extended position, the catwalk preferably overhangs with respect of the machine frame.

The above and other objects and advantages of the invention will become apparent from the detailed description of preferred embodiments, considered in conjunction with the accompanying drawings.

DESCRIPTION OF PREFERRED EMBODIMENTS

Figure 1:
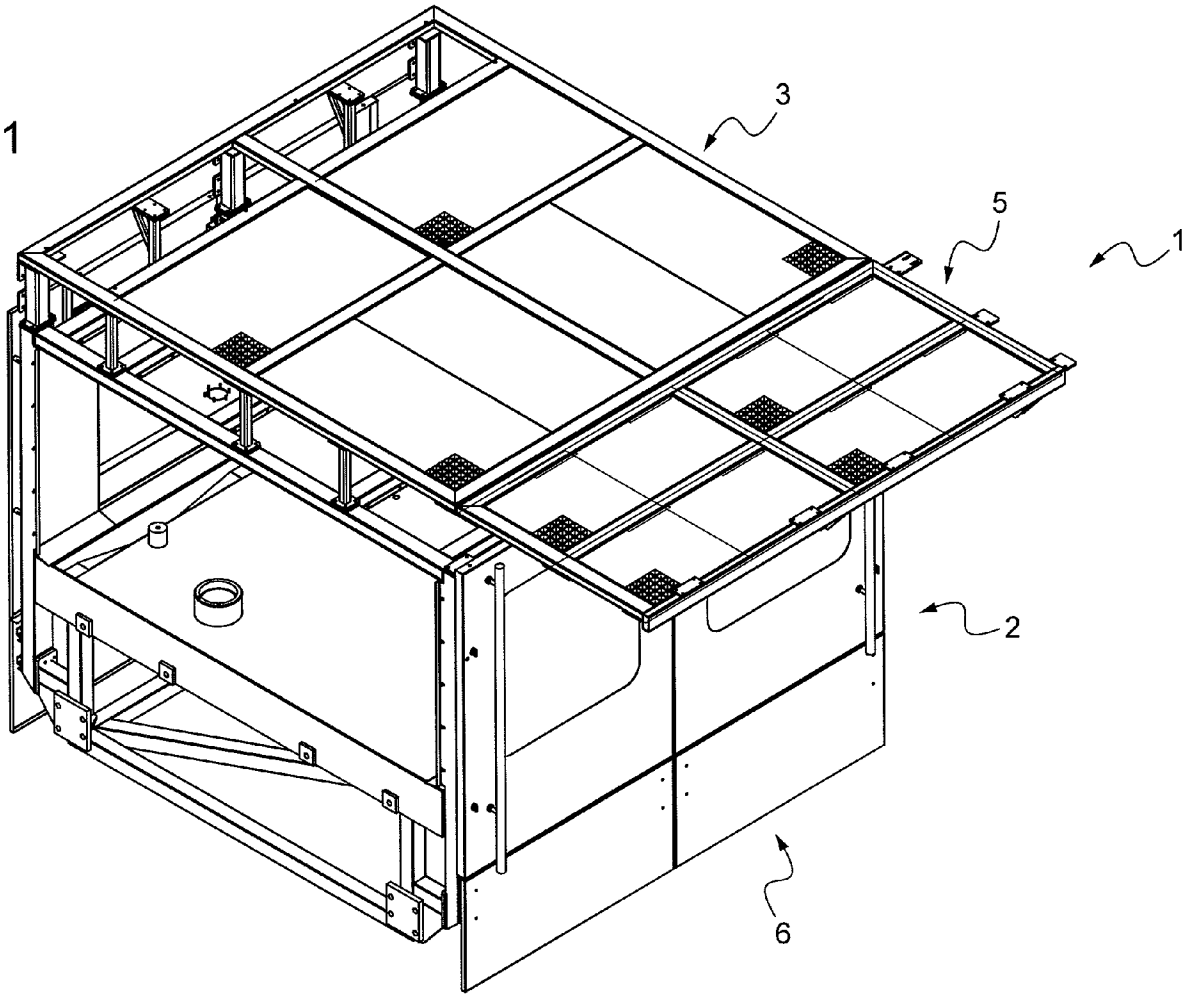
FIG. 1 is a top perspective view of an article handling machine according to the invention, provided with a lateral overhanging catwalk here shown in an extended position.
Figure 2:
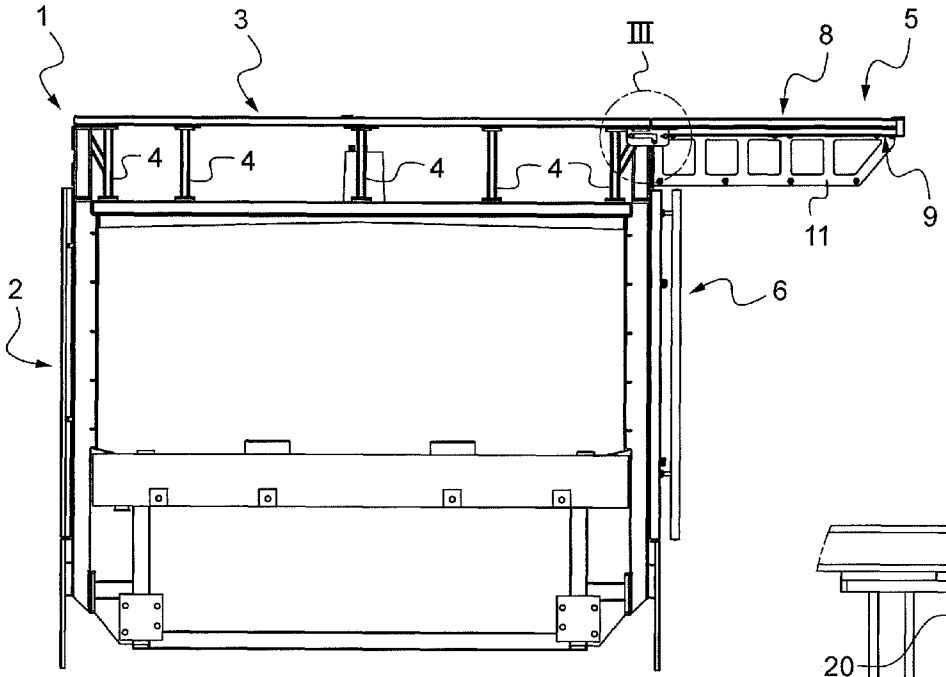
FIG. 2 is a side view of the machine of FIG. 1.
Figure 3:
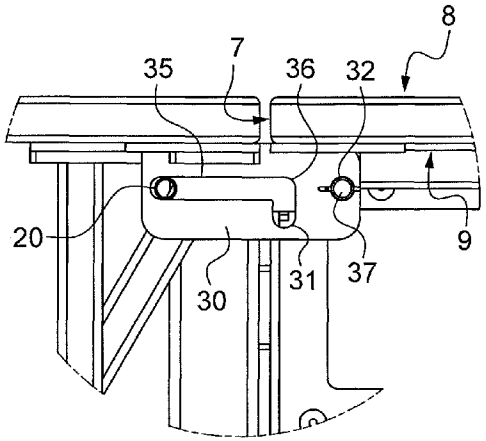
FIG. 3 is a detail view of the machine of FIG. 2, showing an articulation element between the machine and the catwalk.
Figure 4:
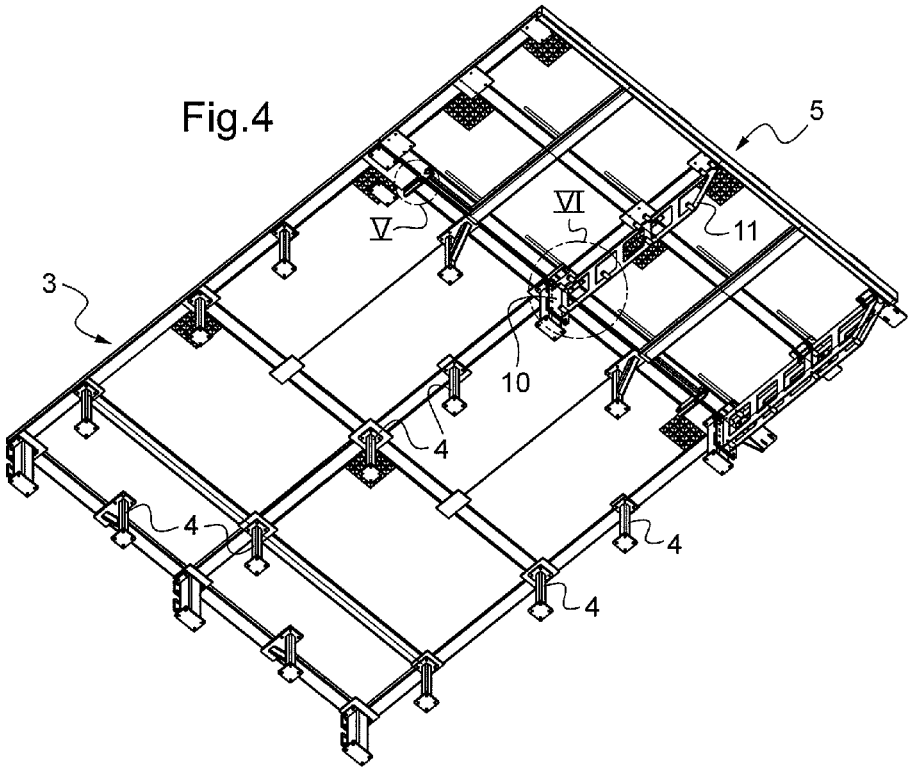
FIG. 4 is a perspective view showing the roof of the handling machine of FIG. 1, wherein the lateral overhanging catwalk is in its extended position, taken from a bottom point of view.
Figure 5:
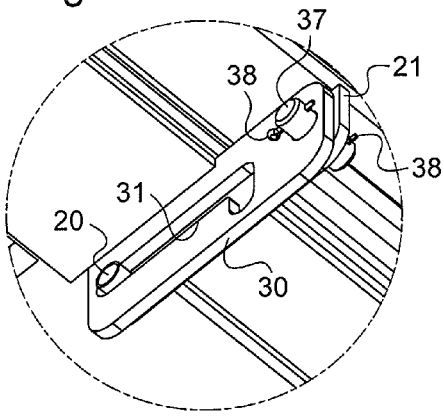
FIG. 5 is a detail view from FIG. 4, showing the articulation element between the machine and the catwalk in the extended position.
Figure 6:
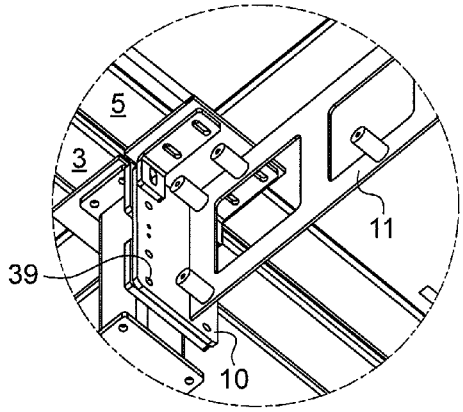
FIG. 6 is a detail view from FIG. 4, showing the contact between the machine and the catwalk.

Referring to the figures, it is shown a machine 1 for handling articles, to be placed on a ground, which comprises a frame 2, delimiting an inner space wherein articles, such as bottles for liquid beverages, are processing. For example, bottles are held and moved on different carrousels inside the machine and they are rinsed, filled, and then capped. The frame defines a table onto which carrousels or other handling devices inside the machine are fixed.

The frame 2 supports a roof 3. Some devices such as electrical cables or cap feed rails for bottles may run between the roof 3 and the frame 2. Moreover, fixation elements of the handling devices inside the machine 1 are positioned on the top of the frame 2 and may extend to the outside.

This is why the roof 3 can preferentially be erected on piles 4 at a distance above the top of the frame 2, as shown in the figures, in order to prevent an operator who needs to get to the top of the frame 2 from damaging devices that can be positioned thereon or from being injured by them.

Furthermore, the machine 1 comprises a catwalk 5, positioned on a lateral side 6 of the machine 1, comprising an inner edge 7, an upper surface 8 and a bottom surface 9. As it can be seen on the figures, the catwalk 5 is preferentially mounted on the machine 1 along the inner edge 7. On the bottom surface 9, a plate 10 is fixed parallel to the inner edge 7. Stiffeners 11 are fixed to the bottom surface 9 of the catwalk and run outwardly from inner edge 7 to the opposite edge.

Between the frame 2 and the catwalk 7, an axis 20 allows the catwalk 5 to swivel with respect of the frame 2, between two positions: an extended position and a folded position.

In the extended position, the inner edge 7 of the catwalk 5 faces the lateral side 6 of the machine 1, and the upper surface 8 extends in a direction substantially parallel to the roof 3. In this position, the upper surface 8 comes in extension to the roof surface. No auxiliary elements link the catwalk 5 to the ground, so that it is hung with respect of the frame 2.

As a matter of fact, in this position, the upper surface 8 is at roof 3 height as shown in FIG. 1-6, so that the working room for an operator is increased, but it can also be at any height along the lateral side 6.

In this position, the plate 10 is in abutment with the frame 2, maintaining the catwalk 5 in position. The stiffeners 11 bring more resistance to the hung catwalk 5 and prevent it from collapsing when a torque in applied on the upper surface 8, for instance under the weight of an operator.

In the folded position, the upper surface 8 comes in a direction substantially parallel to the lateral side 6, whereas the inner edge 7 is facing the ground.

In order to minimize the width of the whole machine 1 in the folded position, the inner edge 7 of the catwalk preferably abuts against the roof 3, and the bottom surface 9 is in the extension of the lateral side 6, so that no part of the catwalk 5 protrudes outwardly from the machine side. That is why the axis 20 is placed forward to the inner edge 7.

As it is clearly depicted in FIG. 3, FIG. 5, FIG. 8 and FIG. 11, the axis 20 is held by an arm 21, protruding outwardly from the catwalk 5 and fixed on the bottom surface 9. The axis 20 is placed on an end portion 22 of the arm 21, the further from the catwalk 5. On an end portion 23 opposite to the axis 20 and below the catwalk 5, the arm 21 comprises an aperture 24.

Facing the arm 21, on the lateral side 6, the frame 2 comprises a flange 30. In the case wherein the catwalk 5 is placed at roof-height, the flange 30 is fixed directly on and below the roof 3. The flange 30 comprises two apertures 31 and 32, placed on two end portions, respectively 33 and 34.

The first aperture 31, the nearest to the roof 3, is intended to receive the axis 20. The aperture 31 comprises a horizontal section 35 and a vertical section 36, crossing each other, allowing the axis 20 to slide in at least two directions, in addition to the swiveling. For instance, the aperture 31 can be L-shaped, as depicted in the figures, but it can also be T-shaped, I-shaped or H-shaped. The horizontal section extends substantially parallel to the roof, the vertical section 36 direction being perpendicular to the horizontal section 35.

The second aperture 32 is on the end portion 34 opposite to the first aperture.

In the extended position, the axis 20 on the arm 21 is positioned in the horizontal section 35 of the flange 30. The catwalk 5 cannot be lifted in the folded position because of the presence of a locking device.

The locking device is managed by the second aperture 32 on the flange 30, coaxial with the aperture 24 on the arm 21. By inserting a fixation lug 37 through the two coaxial apertures 24 and 32, the axis 20 is prevented both from rotating and sliding. The fixation lug 37 is blocked inside the apertures 32 and 24 by a clamping device, comprising two pins 38 inserted through the fixation lug 37, on end portions, one pin 38 being positioned against the flange 30, the other pin against the arm 21.

Moreover, the plate 10 comprises drillings 39, so that it can be fastened to the frame 2.

Consequently, to put the catwalk 5 in the folded position, in a first step, it is necessary to remove the lug 37 from the apertures 32 and 24 and to unfasten the plate 10.

Figure 8:
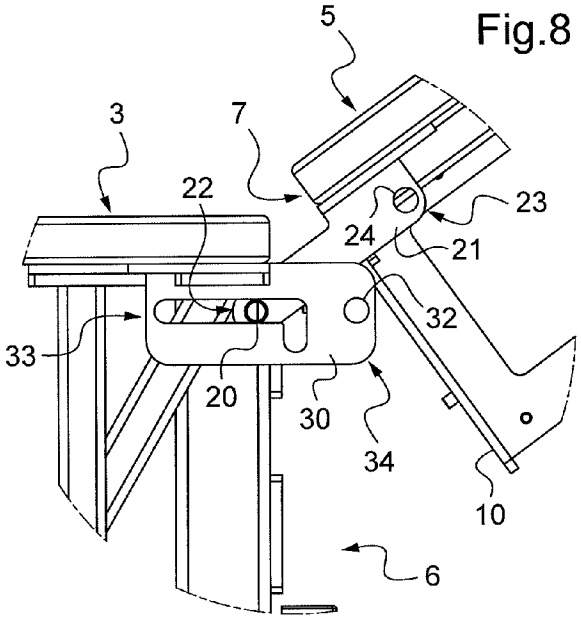
FIG. 8 is a detail view from FIG. 7, showing the articulation element between the machine and the catwalk in the intermediate position.
Figure 7:
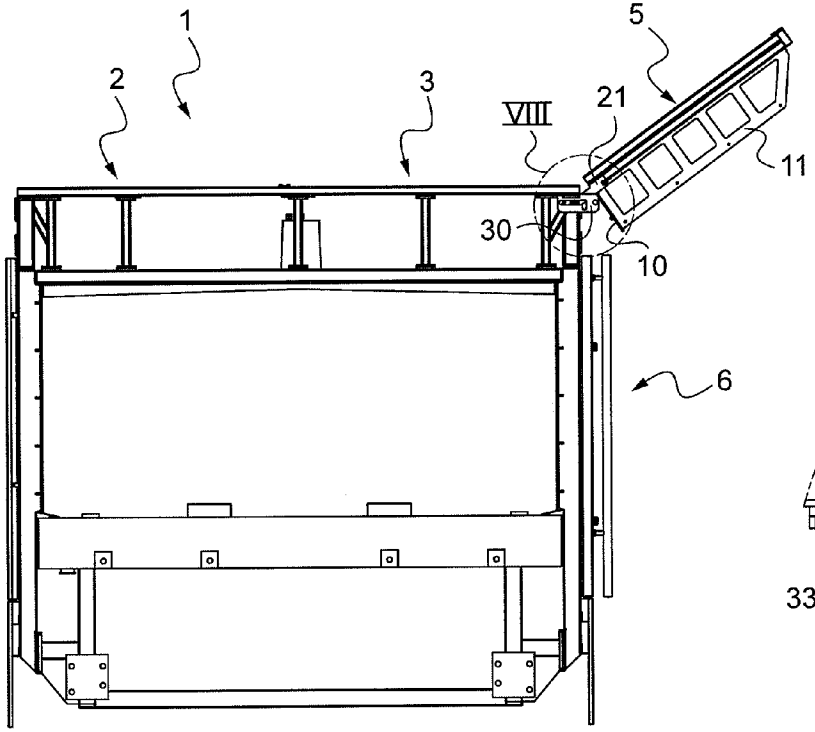
FIG. 7 is a side view of the machine, wherein the catwalk is in an intermediate position.
Figure 9:
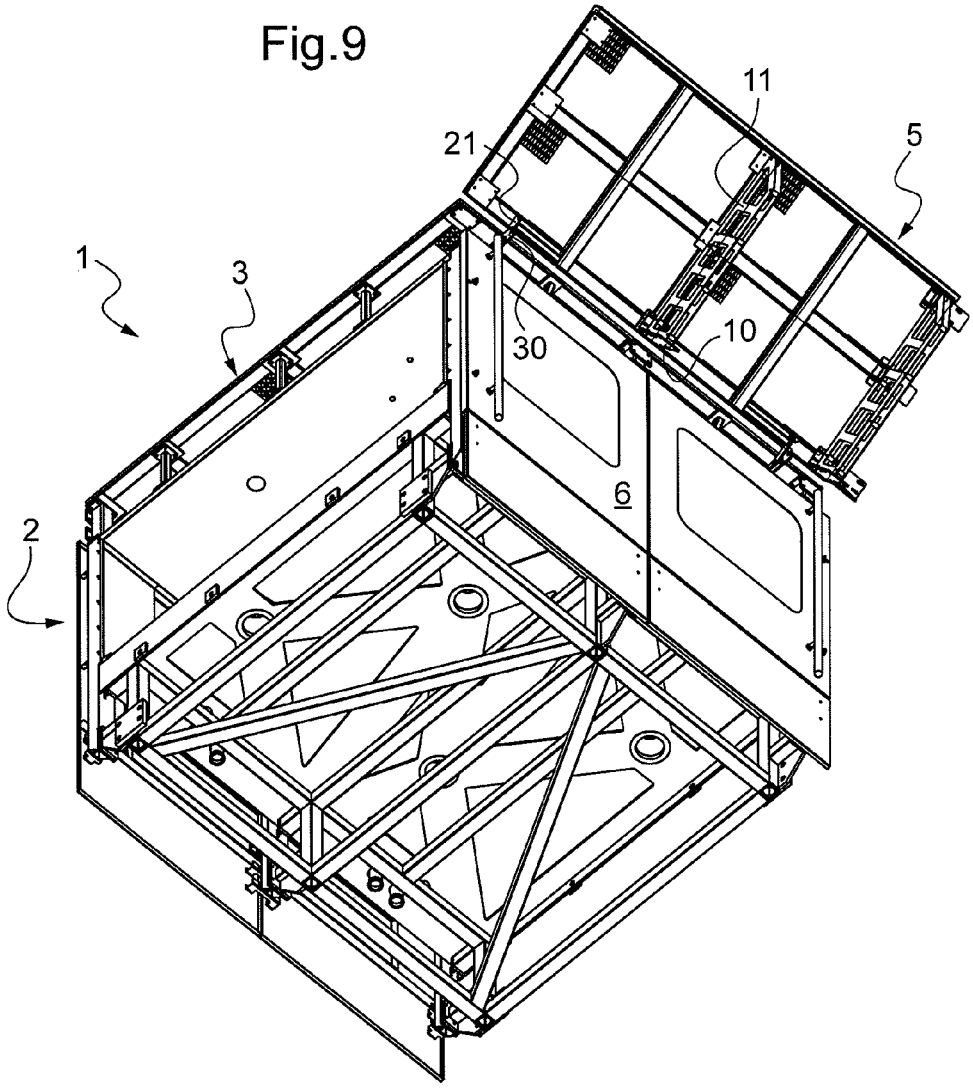
FIG. 9 is a bottom perspective view of the machine of FIG. 7.
Figure 11:
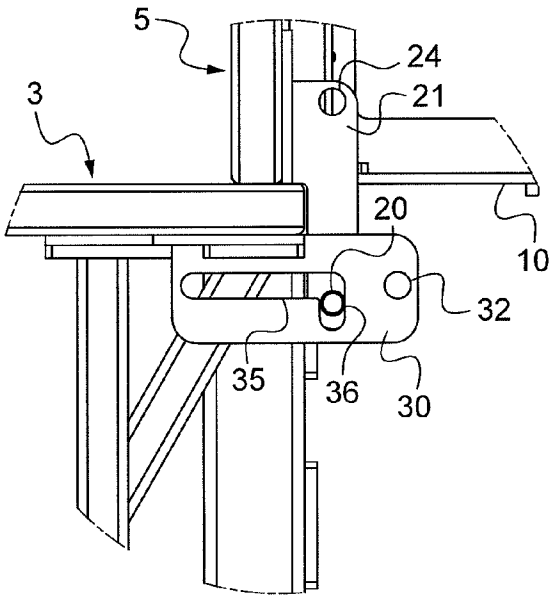
FIG. 11 is a detail view from FIG. 10, showing the articulation element between the machine and the catwalk in the folded position.
Figure 10:
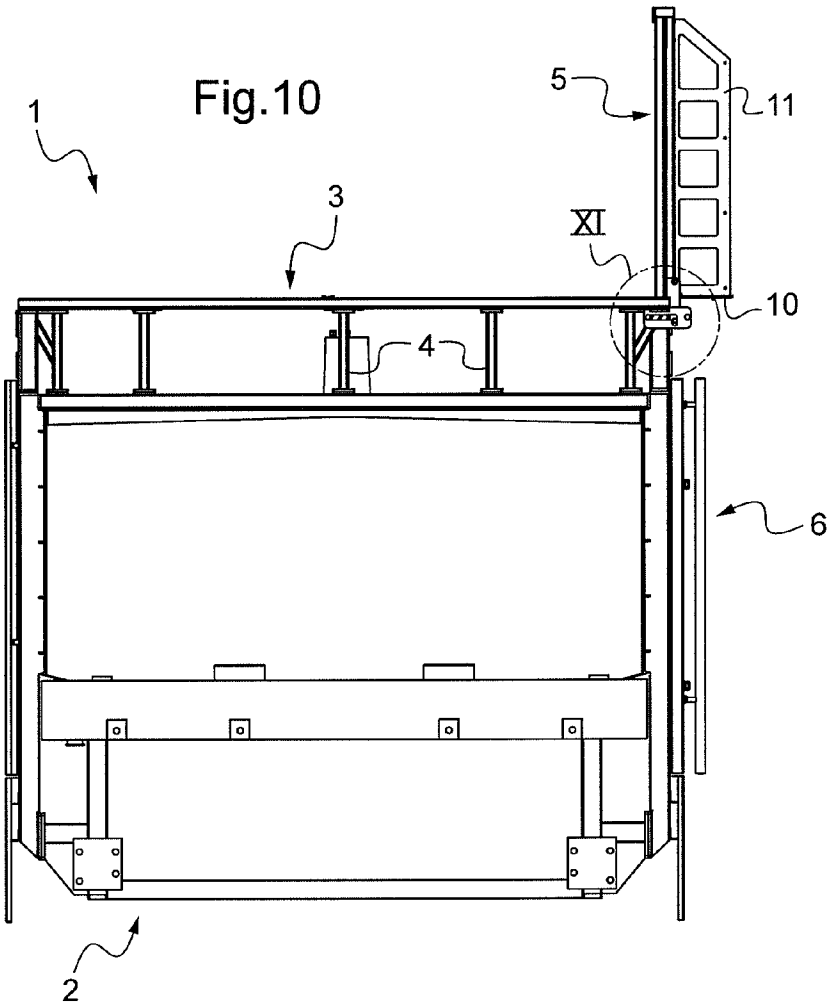
FIG. 10 is a side view of the machine, wherein the catwalk is in a folded position.
Figure 12:
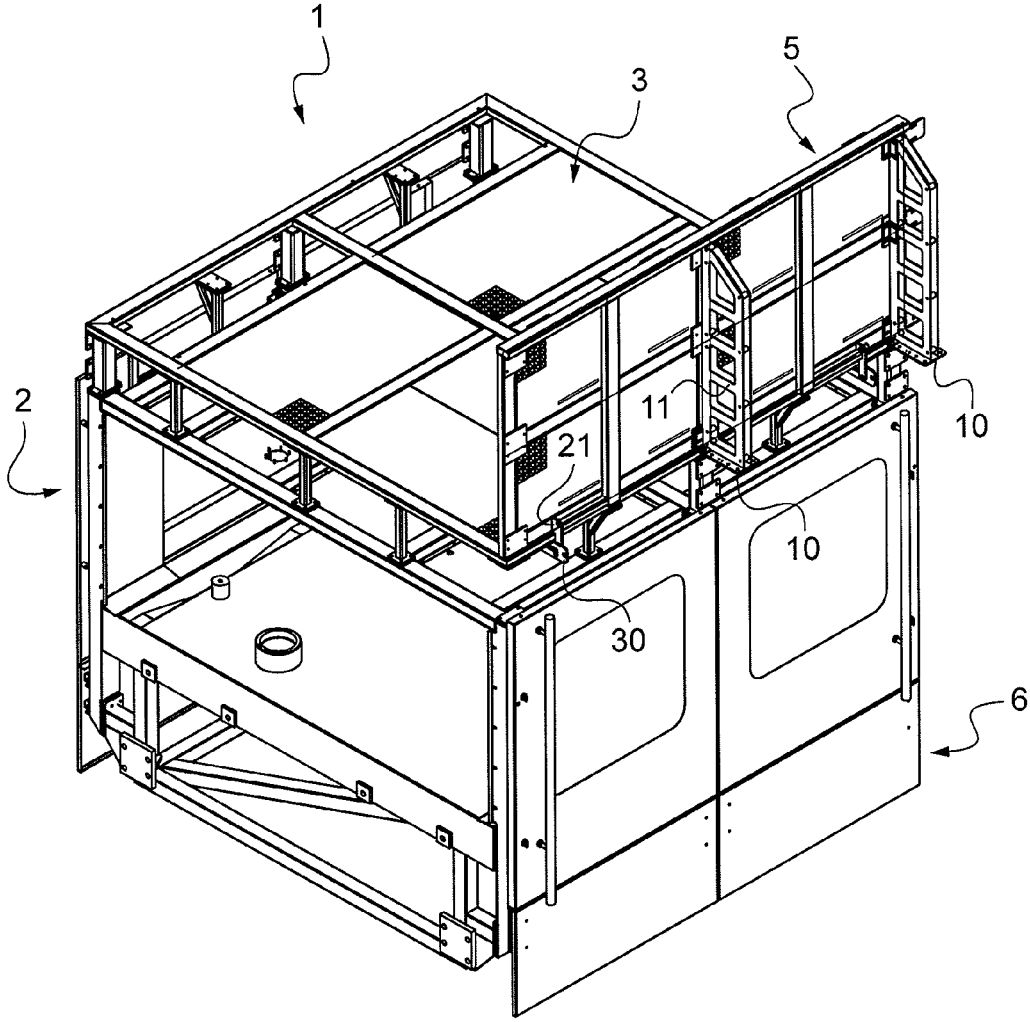
FIG. 12 is a top perspective view of the machine of FIG. 10.

Then, in a second step, the axis 20 slides in the first aperture 31 of the flange 30, along the horizontal section 35, moving away the catwalk 5 from the frame 2, and slightly swivels, in an intermediate position, as shown in FIG. 7-9. The second aperture 32 on the flange 30 and the aperture on the arm 21 are then no more coaxial, and the plate 10 is separated from the frame 2. The axis 20 slides away from the frame 2 to one end of the horizontal section 35, passing in the vertical section 36.

In a third step, the catwalk 5 is lifted, the axis 20 sliding vertically in the aperture 31, in such a way that the inner edge 7 is higher than the roof 3, and the catwalk 5 is pivoted so that the inner edge 7 is substantially parallel to the roof 3.

Eventually, in a fourth step, the inner edge 7 is put in abutment with the roof 3, the axis 20 coming in a lower position inside the vertical section 36; whereby the catwalk 5 stands then in its folded position.

The reverse operation can be applied to put the catwalk 5 from the folded position in the extended position.

According to the present invention, the width of the machine 1 is not increased when the catwalk 5 is in the folded position, so that no special conditioning is required to transport the machine 1. The machine 1 can still enter classic transportation vehicles.

Furthermore, when the machine 1 is undergoing setting or maintenance operations, the roof surface can be increased by the deployment of the catwalk 5, so that an operator can stand on the roof 3 at ease for setting or maintenance operations.

The invention claimed is:

1. An article handling machine, comprising:

a frame for receiving article handling elements on a horizontal table;

a roof covering said table, the roof extending in a horizontal plane and structured as horizontal platform for supporting an operator; and a catwalk at a lateral side of the machine;

the catwalk is mounted on the frame at roof-height to pivot between and extended position in which the catwalk extends substantially in the horizontal plane of the roof, thereby extending the horizontal platform for supporting the operator and a folded position in which the catwalk extends in a direction substantially perpendicular to the horizontal plane of the roof, wherein the frame comprises a flange, on the lateral side, said flange comprising an aperture, and wherein the lateral catwalk comprises an axis, positioned near the inner edge, in the flange aperture, so that the catwalk can swivel around the machine, between the extended position and the folded position, by the rotation of the axis in the aperture, the flange aperture has a profile comprising a horizontal section receiving the axis in the extended position, and a vertical section receiving the axis in the folded position, further comprising a bottle handling device operatively located inside the machine that holds and moves bottles.

2. The article handling machine according to claim 1, wherein comprising an electrical cabinet mounted on the roof.

3. The article handling machine according to claim 1, comprising a locking device for holding the catwalk in the extended position.

4. The article handling machine according to claim 3 wherein the locking device includes apertures positioned on the catwalk and the machine, in such a way that, in the extended position, an aperture in the machine is coaxial with an aperture in the catwalk, and wherein the locking device further includes a fixation lug mounted through the apertures, for holding the catwalk in the extended position.

5. The article handling machine according to claim 4, wherein the fixation lug comprises a clamping device for tightening the lug in the apertures and.

6. The article handling machine according to claim 5, wherein the clamping device includes two pins transversally inserted through the fixation lug on end portions.

7. The article handling machine according to claim 1, wherein the catwalk comprises a plate, stretching out substantially perpendicularly to the catwalk and which, in the extended position, comes into abutment with the lateral side.

8. The article handling machine according to claim 7, wherein, in the extended position, the plate is fixed to the frame.

9. The article handling machine according to claim 7, wherein the catwalk comprises a stiffener extending outwardly from the plate.

* * * * *